US008602226B1

(12) United States Patent
Chen et al.

(10) Patent No.: US 8,602,226 B1
(45) Date of Patent: Dec. 10, 2013

(54) VENDING MACHINE WITH PIVOTABLE PARTITION PLATES

(71) Applicants: Hong Fu Jin Precision Industry (WuHan) Co., Ltd., Wuhan (CN); Hon Hai Precision Industry Co., Ltd., New Taipei (TW)

(72) Inventors: Yun-Lung Chen, New Taipei (TW); Chin-Wen Yeh, New Taipei (TW); Yang Xiao, Wuhan (CN); Dun-Jun Zhou, Wuhan (CN)

(73) Assignees: Hong Fu Jin Precision Industry (WuHan) Co., Ltd., Wuhan (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/851,687

(22) Filed: Mar. 27, 2013

(30) Foreign Application Priority Data

May 21, 2012 (CN) ..... 2012 1 0158037

(51) Int. Cl.
*A47F 7/00* (2006.01)

(52) U.S. Cl.
USPC ..... 211/59.4; 211/184; 221/241

(58) Field of Classification Search
USPC ..... 211/59.2–59.4, 184; 312/330.1, 407; 221/1, 123, 124, 133, 154, 241
See application file for complete search history.

(56) References Cited

U.S. PATENT DOCUMENTS

| | | | | | |
|---|---|---|---|---|---|
| 2,910,188 | A * | 10/1959 | Skolfield et al. | ..... | 211/184 |
| 3,501,019 | A * | 3/1970 | Armstrong et al. | ..... | 211/184 |
| 4,703,982 | A * | 11/1987 | Rock et al. | ..... | 312/330.1 |
| 4,757,915 | A * | 7/1988 | Albright et al. | ..... | 221/75 |
| 5,450,968 | A * | 9/1995 | Bustos | ..... | 211/59.2 |
| 6,880,903 | B2 * | 4/2005 | O'Halloran et al. | ..... | 312/407 |
| 8,016,139 | B2 * | 9/2011 | Hanners et al. | ..... | 211/184 |

* cited by examiner

*Primary Examiner* — Korie H Chan
(74) *Attorney, Agent, or Firm* — Altis Law Group, Inc.

(57) ABSTRACT

A vending machine includes a tray, at least one partition plate, and a mounting member pivotably attached to the at least one partition plate. The tray includes a base panel, a side panel extending from the base panel, and at least one tab extending from the base panel. A gap is defined in the side panel. The at least one partition plate is pivotably attached to the at least one tab. The mounting member is rotatable between a latched position, where the mounting member is engaged with the gap, and the at least one partition plate is secured in an upright position that is substantially perpendicular to the base panel, and a released position, where the mounting member is disengaged from the gap, and the at least one partition plate is rotatable away from the upright position to enlarge a space beside the at least one partition plate.

20 Claims, 5 Drawing Sheets

VENDING MACHINE WITH PIVOTABLE PARTITION PLATES

BACKGROUND

1. Technical Field

The present disclosure relates to a vending machine, more particularly to a vending machine with pivotable partition plates.

2. Description of Related Art

Vending machines typically include a tray and a plurality of partition plates attached in the tray. A product transmitting passage is located between each two adjacent partition plates for transmitting products out from the vending machine. Sometimes, the product transmitting passage is not wide enough to accommodate the products. Some of the partition plates need to be detached from the tray to provide a wider space for placing the products. However, it is inconvenient to mount and dismount the partition plates in the tray.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation. In the figures of the accompanying drawings, like references indicate similar elements. It should be noted that references to "an" or "one" embodiment in this disclosure are not necessarily to the same embodiment, and such references mean "at least one."

Figure 1:
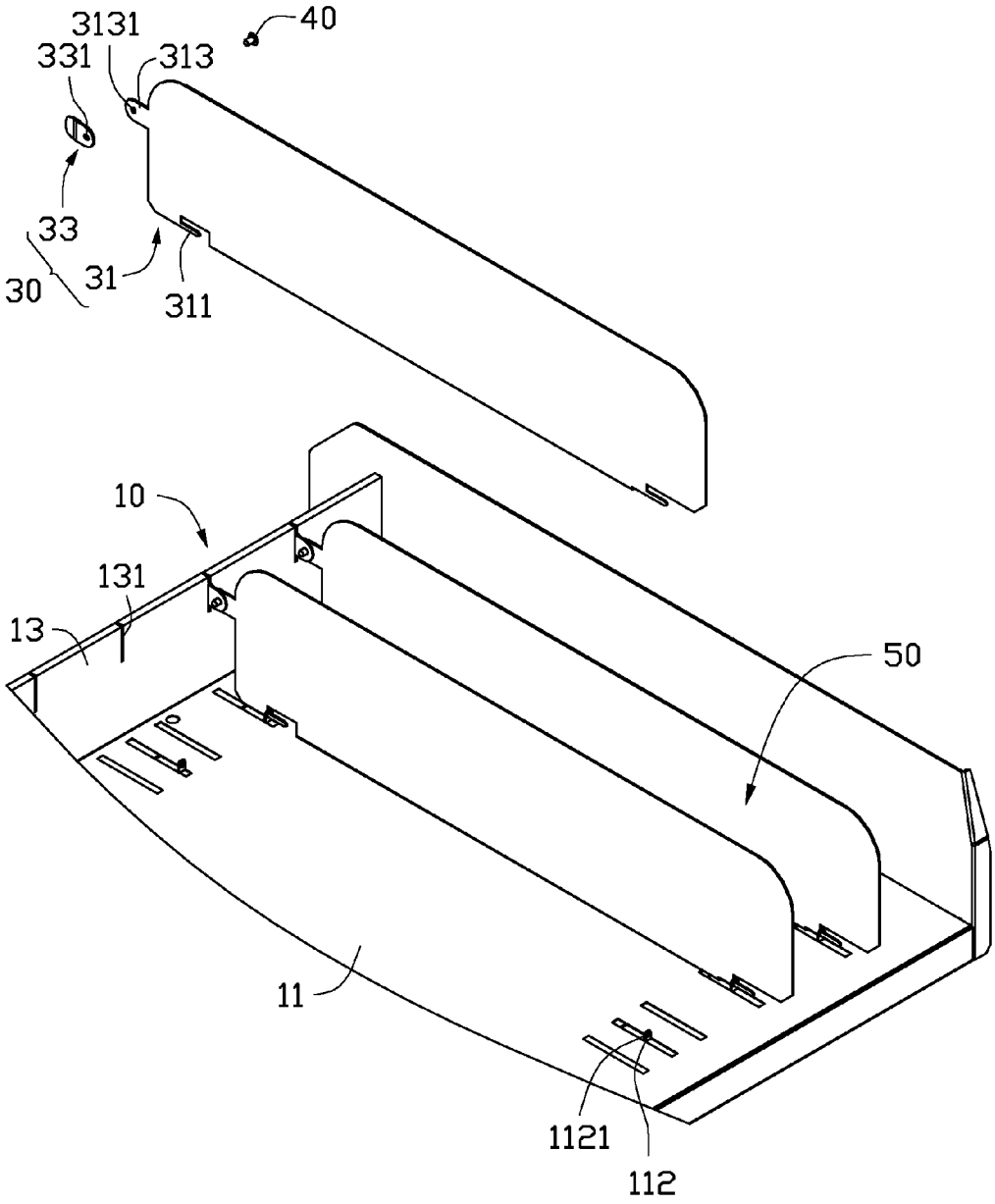
FIG. 1 is an isometric, exploded view of a vending machine in accordance with an embodiment.
Figure 2:
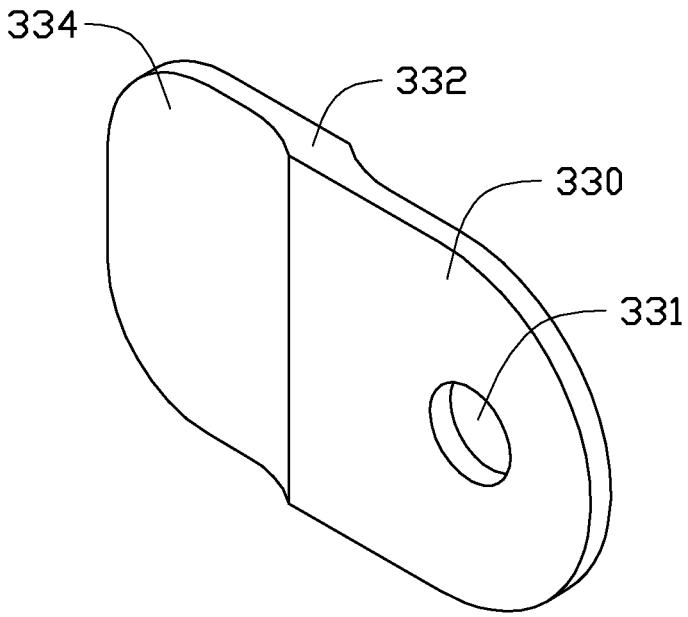
FIG. 2 is an enlarged view of a mounting member in FIG. 1.

Referring to FIGS. 1 and 2, an embodiment of a vending machine includes a tray 10 and a plurality of partition assemblies 30. Each of the plurality of partition assemblies 30 includes a partition plate 31 and a mounting member 33. The mounting member 33 can be pivotably attached to the partition plate 31 by a fastener 40.

The tray 10 includes a base panel 11 and a side panel 13 extending substantially perpendicularly from an edge of the base panel 11. A pair of tabs 112 extends upwardly from the base panel 11 for mounting the partition plate 31. The pair of tabs 112 is substantially parallel to the side panel 13. A pair of pivot holes 1121 is defined in the pair of tabs 112. A gap 131 is defined in an upper portion of the side panel 13 for engaging with the mounting member 33.

The partition plate 31 has roughly a rectangular shape. The partition plate 31 includes a pair of pivot tabs 311 located at a long edge of the partition plate 31 for engaging with the pair of pivot holes 1121. A mounting piece 313 protrudes from a short edge of the partition plate 31. A first mounting hole 3131 is defined in the mounting piece 313 corresponding to the fastener 40. The mounting piece 313 and the pair of pivot tabs 311 lie in the same plane as a main portion of the partition plate 31.

The mounting member 33 includes a mounting portion 330, a connecting portion 332 and an operation portion 334. The connecting portion 332 is connected to and located between the mounting portion 330 and the operation portion 334. A second mounting hole 331 is defined in the mounting portion 330 corresponding to the first mounting hole 3131. In one embodiment, a thickness of the connecting portion 332 is greater than the thickness of the operation portion 334 and the thickness of the mounting portion 330. A width of the gap 131 is not less than the thickness of the operation portion 334 but is less than the thickness of the connecting portion 332.

Figure 3:
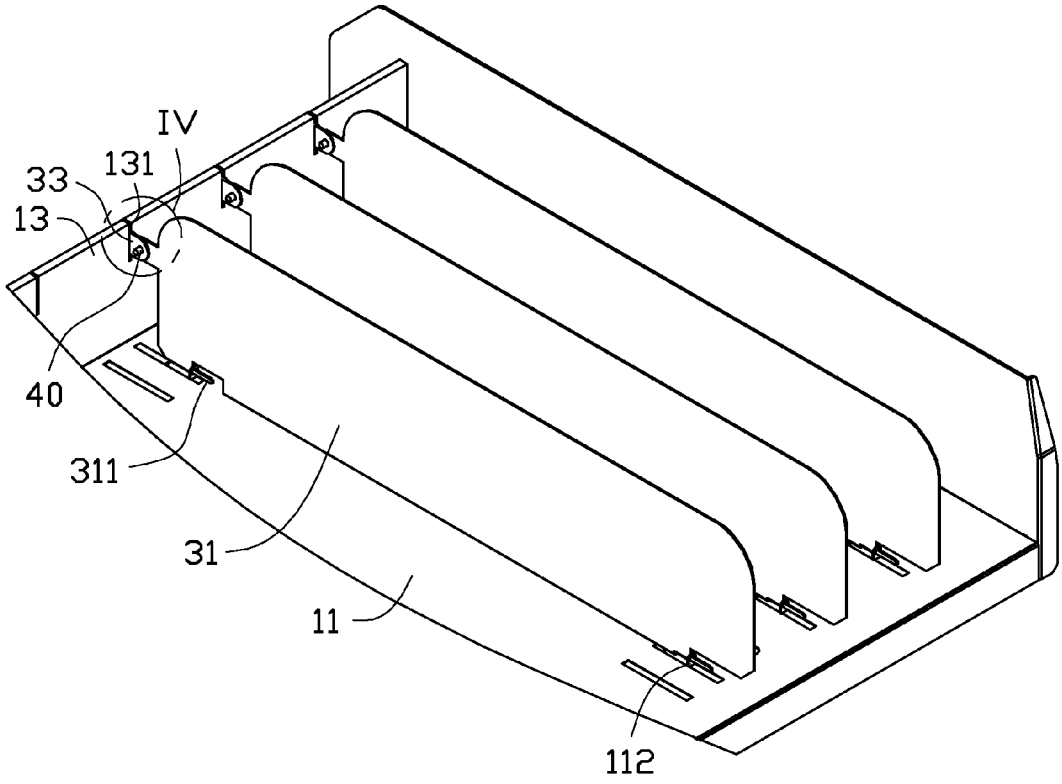
FIG. 3 is an assembled view of the vending machine in FIG. 1, showing a partition plate in a first position.
Figure 4:
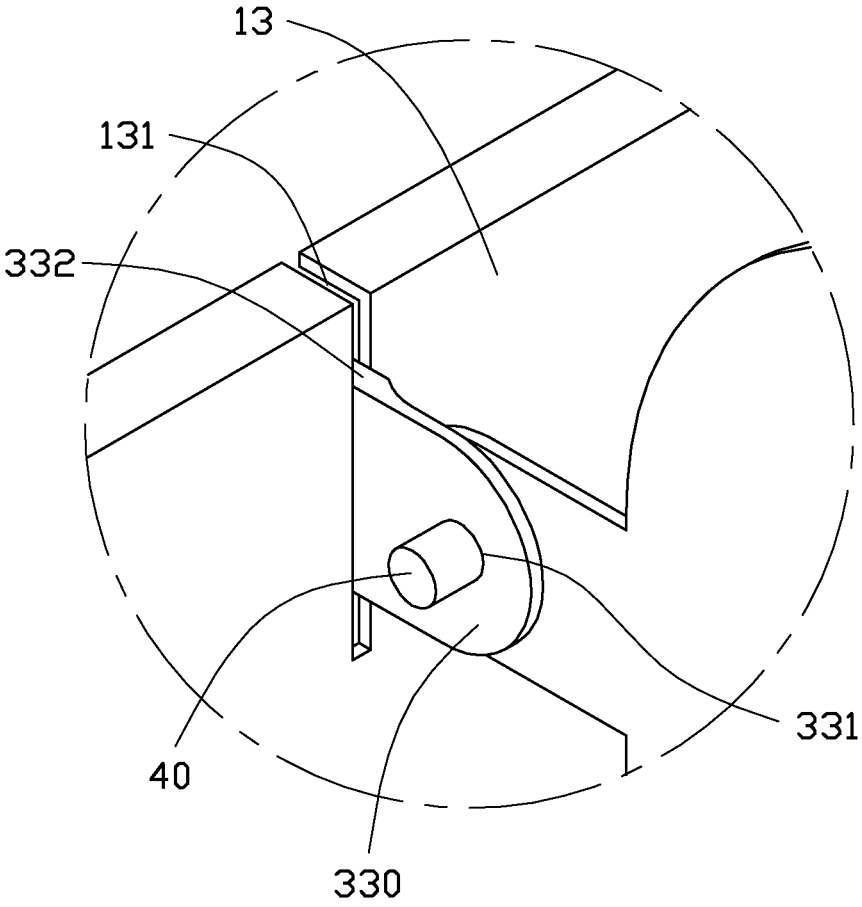
FIG. 4 is an enlarged view of the circled portion IV in FIG. 3.
Figure 5:
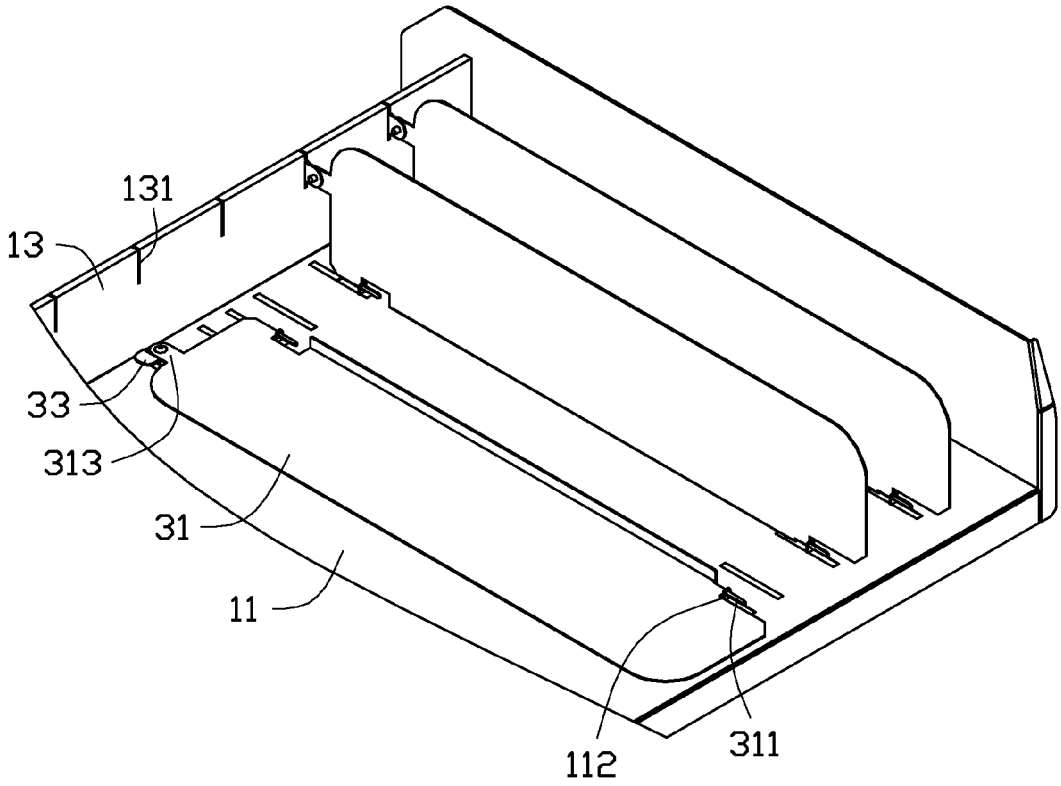
FIG. 5 is another assembled view of the vending machine in FIG. 1, showing the partition plate in a second position.

Referring to FIGS. 3 to 5, in assembly, the mounting piece 313 is located in the gap 131. The pair of pivot tabs 311 is aligned with the pair of pivot holes 1121. The partition plate 31 moves away from the side panel 13 along a direction that is perpendicular to the side panel 13. The pair of pivot tabs 311 is engaged in the pair of pivot holes 1121. The mounting piece 313 moves away from the gap 131. The first mounting hole 3131 is aligned with the second mounting hole 331. The fastener 40 extends through the first mounting hole 3131 and the second mounting hole 331. The mounting member 33 is pivotably attached to the partition plate 31 by the fastener 40.

When the mounting member 33 is rotated to a latched position (see FIGS. 3 and 4), the operation portion 334 is engaged in the gap 131. The connecting portion 332 abuts the gap 131 for preventing the partition plate 31 from disengaging from the pair of pivot holes 1121. The partition plate 31 is secured in a first position, where the partition plate 31 is substantially perpendicular to the base panel 11 and the side panel 13.

When the mounting member 33 is rotated 90 degrees clockwise from the latched position to a released position (see FIG. 5), the operation portion 334 is disengaged from the gap 131. The partition plate 31 can rotate 90 degrees from the first position to a second position, where the partition plate 31 is substantially parallel to the base panel 11. Since each partition plate in the tray 10 is rotatable, an accommodating space between two adjacent partition plates can be adjusted to accommodate products with different sizes.

While the present disclosure has been illustrated by the description in this embodiment, and while the embodiment has been described in detail, it is not intended to restrict or in any way limit the scope of the appended claims to such details. Additional advantages and modifications within the spirit and scope of the present disclosure will readily appear to those skilled in the art. Therefore, the present disclosure is not to be limited to the specific details and illustrative examples shown and described.

What is claimed is:

1. A vending machine comprising:

a tray comprising a base panel, a side panel extending from the base panel, and at least one tab extending from the base panel, a gap being defined in the side panel;

at least one partition plate pivotably attached to the at least one tab; and a mounting member pivotably attached to the at least one partition plate;

wherein the mounting member is rotatable between a latched position, where the mounting member is engaged with the gap, and the at least one partition plate is secured in an upright position that is substantially perpendicular to the base panel; and a released position, where the mounting member is disengaged from the gap, and the at least one partition plate is rotatable away from the upright position to enlarge a space beside the at least one partition plate.

2. The vending machine of claim 1, wherein a pivot hole is defined in the at least one tab, and the at least one partition plate comprises at least one pivot tab engaged with the pivot hole.

3. The vending machine of claim 2, wherein the at least one partition plate has a roughly rectangular shape, and the at least one pivot tab is located at a long edge of the at least one partition plate.

4. The vending machine of claim 3, wherein a mounting piece protrudes from a short edge of the at least one partition plate, and the mounting member is pivotably attached to the mounting piece.

5. The vending machine of claim 4, wherein the mounting piece and the at least one pivot tab lie in the same plane as a main portion of the at least one partition plate.

6. The vending machine of claim 4, wherein a first mounting hole is defined in the mounting piece, a second mounting hole is defined in the mounting member, and a fastener extends through the first mounting hole and the second mounting hole for pivotally attaching the mounting member to the mounting piece.

7. The vending machine of claim 6, wherein the mounting member comprises a mounting portion, an operation portion, and a connecting portion that is connected to and located between the mounting portion and the operation portion, and the second mounting hole is defined in the mounting portion.

8. The vending machine of claim 7, wherein when the mounting member is located at the latched position, the operation portion is located in the gap, and the connecting portion abuts the gap, for preventing the at least one pivot tab from disengaging from the pivot hole.

9. The vending machine of claim 8, wherein a thickness of the connecting portion is greater than the thickness of the operation portion and the thickness of the mounting portion.

10. The vending machine of claim 9, wherein a width of the gap is not less than the thickness of the operation portion, but less than the thickness of the connecting portion.

11. A vending machine comprising:

a tray comprising a base panel, a side panel extending substantially perpendicularly from the base panel, and at least one tab extending from the base panel, a gap being defined in the side panel;

at least one partition plate, pivotably attached to the at least one tab, and rotatable along a first axis that substantially perpendicular to the side panel; and a mounting member, pivotably attached to the at least one partition plate, and rotatable along a second axis that is substantially parallel to the side panel;

wherein the mounting member is rotatable between a latched position, where the mounting member is engaged with the gap, and the at least one partition plate is secured in an upright position that is substantially perpendicular to the base panel; and a released position, where the mounting member is disengaged from the gap, and the at least one partition plate is rotatable away from the upright position to enlarge a space beside the at least one partition plate.

12. The vending machine of claim 11, wherein a pivot hole is defined in the at least one tab, and the at least one partition plate comprises at least one pivot tab engaged with the pivot hole.

13. The vending machine of claim 12, wherein the at least one partition plate has a roughly rectangular shape, and the at least one pivot tab is located at a long edge of the at least one partition plate.

14. The vending machine of claim 13, wherein a mounting piece protrudes from a short edge of the at least one partition plate, and the mounting member is pivotably attached to the mounting piece.

15. The vending machine of claim 14, wherein a first mounting hole is defined in the mounting piece, a second mounting hole is defined in the mounting member, and a fastener extends through the first mounting hole and the second mounting hole for pivotally attaching the mounting member to the mounting piece.

16. The vending machine of claim 15, wherein the mounting member comprises a mounting portion, an operation portion, and a connecting portion that is connected to and located between the mounting portion and the operation portion, and the second mounting hole is defined in the mounting portion.

17. The vending machine of claim 16, wherein when the mounting member is located at the latched position, the operation portion is located in the gap, and the connecting portion abuts the gap for preventing the at least one pivot tab from disengaging from the pivot hole.

18. The vending machine of claim 17, wherein a thickness of the connecting portion is greater than the thickness of the operation portion and the thickness of the mounting portion.

19. The vending machine of claim 18, wherein a width of the gap is not less than the thickness of the operation portion, but less than the thickness of the connecting portion.

20. The vending machine of claim 11, wherein the at least one tab is substantially parallel to the side panel.

* * * * *